United States Patent [19]

Pinson

[11] Patent Number: 4,699,333

[45] Date of Patent: Oct. 13, 1987

[54] ON-BOARD FLIGHT CONTROL PANEL SYSTEM

[75] Inventor: George T. Pinson, Huntsville, Ala.

[73] Assignee: The Boeing Company, Seattle, Wash.

[21] Appl. No.: 569,211

[22] Filed: Nov. 7, 1984

[51] Int. Cl.[4] ..... F42B 15/02

[52] U.S. Cl. ..... 244/3.21; 244/3.28

[58] Field of Search ..... 244/3.21, 3.27, 3.28, 244/3.29; 102/384, 386, 388

[56] References Cited

U.S. PATENT DOCUMENTS

| | | | |
|---|---|---|---|
| 2,520,433 | 8/1950 | Robinson | 244/3.21 |
| 2,941,764 | 6/1960 | Lee, Jr. et al. | 244/3.28 |
| 3,004,489 | 10/1961 | Griffith et al. | 244/3.21 |
| 3,114,315 | 12/1963 | Trump | 102/388 |
| 3,125,313 | 3/1964 | Soderberg | 244/3.21 |
| 3,188,958 | 6/1965 | Burke et al. | 244/3.21 |
| 3,305,194 | 2/1967 | Conard et al. | 244/3.21 |
| 3,343,767 | 9/1967 | Cafissi | 244/3.27 |
| 4,033,525 | 7/1977 | Leonard et al. | 244/3.21 |
| 4,175,491 | 11/1979 | Thomanek | 244/3.27 |

FOREIGN PATENT DOCUMENTS

| | | | |
|---|---|---|---|
| 1188651 | 4/1970 | United Kingdom | 244/3.27 |

*Primary Examiner*—Charles T. Jordan

[57] ABSTRACT

A missile on-board pitch, yaw and roll flight control panel system, the system having a plurality of control panels operated by an actuator drive. The edge of the control panels slanted so when the panels are in an open position, clockwise and counter clockwise roll of the missile can be controlled.

5 Claims, 11 Drawing Figures

ON-BOARD FLIGHT CONTROL PANEL SYSTEM

BACKGROUND OF THE INVENTION

The subject invention provides for pitch, yaw and clockwise and counter clockwise roll control of a missile and more particularly but not by way of limitation to the use of a plurality of control panels which are slanted for controlling clockwise and counter clockwise roll of a missile.

Heretofore, there have been various types of missile control systems and arrangements such as drag controls, brake flaps and fins for controlling the operation of the missile. These devices and systems are disclosed in the following United States Patents: U.S. Pat. No. 2,793,591 to Jasse, U.S. Pat. No. 2,941,764 to Lee, Jr. et al, U.S. Pat. No. 2,942,545 to Fogal et al, U.S. Pat. No. 3,004,489 to Griffith et al, U.S. Pat. No. 3,114,315 to Trump, U.S. Pat. No. 3,174,430 to Apotheloz, U.S. Pat. No. 3,188,958 to Burke et al, U.S. Pat. No. 3,343,767 to Cafissi, U.S. Pat. No. 3,588,004 to Suter, U.S. Pat. No. 3,622,103 to Meier.

None of the above mentioned patents provide the unique features and advantages of the subject invention.

SUMMARY OF THE INVENTION

The subject missile on-board flight control panel system provides an effective and efficient means of controlling the pitch, yaw and clockwise and counter clockwise roll of a missile.

The invention provides both control surfaces and actuators for use in steering the missile in response to control and steering commands. The control panel system can also be used where severe packaging restrictions occur such as in the case of tactical and shoulder fired small diameter missiles and projectile.

The control panel system is effective for speeds of 200 feet per second and greater.

The subject on-board flight control panel system is simple in design, inexpensive and provides for controlling the flight and orientation of the missile and can be used effectively at supersonic and hypersonic speeds.

The on-board flight control panel system for controlling pitch, yaw and clockwise and counter clockwise roll of a missile includes a plurality of control panels hinged on the missile and forming a part of the missile skin. Actuators are connected to each panel for opening and closing individual panels into the airstream of the missile. A potentiometer is connected to each of the actuators for monitoring the position of the control panel. A control system is connected to each potentiometer for determining the position of the panels. A plurality of rate sensors can be connected to the control system for indicating actual missile or projectile orientation and rate of change of orientation to the autopilot control system.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
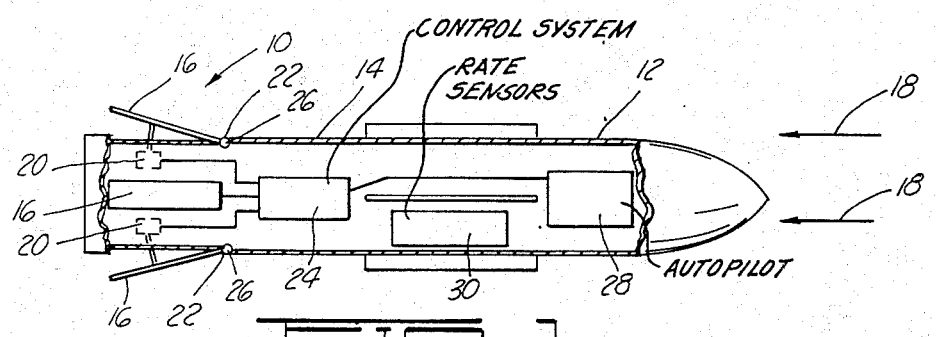
FIG. 1 illustrates a side view of the missile on-board flight control panel system mounted on a missile.

In FIG. 1 the on-board flight control panel system is designated by general reference numeral 10. The system is installed on a missile or projectile. A portion of a missile skin 14 may be made of a plurality of control panels 16 which are raised into the airstream by an actuator 20 mounted inside the missile 12. Airstream is indicated by arrow 18. The control panels 16 are rotated about a hinge 22 attached to the missile 12. Feedback to a control system 24 is provided by a feedback position measuring device which may be a potentiometer 26 shown in greater detail in FIG. 6.

An autopilot 28 controls the direction and attitude of the missile 12 by monitoring the actual orientation and rate of change of orientation as indicated by rate sensors 30, gyro or similar type of instrumentation. The autopilot 28 is preprogrammed with knowledge of a desired flight profile to the target's position and reacts and responds to a seeker tracking the target to provide steering commands to the control system 24. The position of the control panels 16 is obtained by monitoring the potentiometer 26. The required positions of the individual control panels 16 are determined and commands issued to the actuators 20 by the control system 24. It should be noted that while the control system 24 and autopilot 28 are shown separately, the control system 24 may be incorporated into the autopilot 28.

Figure 2A:
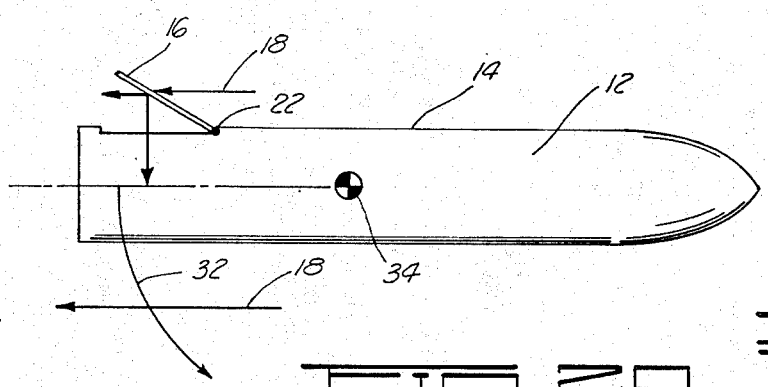
FIG. 2A and 2B illustrate a side and front view of the missile with a control panel in an extended position.
Figure 2B:
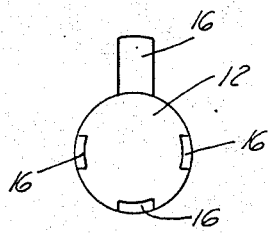

In FIG. 2A and 2B the missile 12 is shown and in this example four control panels 16 are used. But it is recognized three or more could be used to accomplish the same results. The resultant control forces generated by the panel 16 are a function of the missile's speed and the effective aerodynamic area of the panel 16. Differential motion of each panel 16 provides total directional control. It is assumed, in this example, the panels 16 are flush with and symetrical with the missile's skin 14 when in a closed position. By slanting the edge of the panel 16 several degrees clockwise and counter clockwise roll control about a turning point indicated by arrow 32 is provided. The missile's center of gravity is indicated by numeral 34.

Figure 3A:
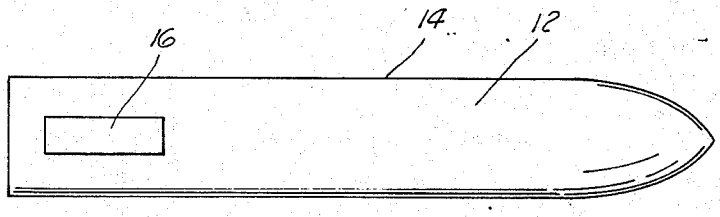
FIG. 3A and 3B illustrate the missile with an erected control panel and a slanted control panel.
Figure 3B:
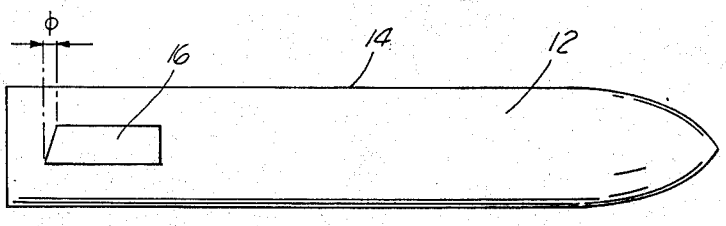

In FIG. 3A and 3B the missile 12 is shown with one of the panels 16 in an erected position. By slanting one of the panels several degrees, roll control can be provided. In FIG. 3B, the panel 16 is slanted an angle $\Phi$.

The opposite panel 16 would also be slanted an equal angle $\Phi$ for roll in a clockwise direction. In this example, the upper and lower panels would be slanted at an equal angle in the opposite direction for roll in a counter clockwise direction. Opening each panel an equal amount would provide for compensating for the roll in opposite directions.

Figure 4:
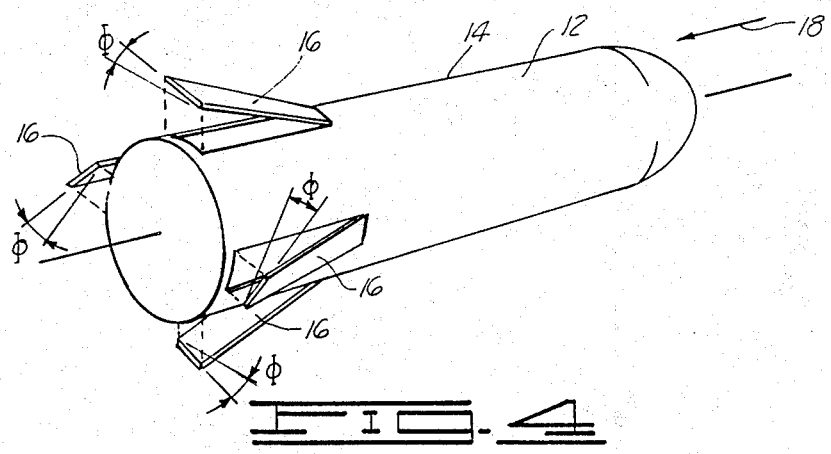
FIG. 4 illustrates a perspective view of the missile with the control panels in an extended open position.

In FIG. 4 a perspective view of the panel 16 is shown in an erected position on the missile 12 with the upper and lower panels in a forward slanted position and the two panels on the left and right side of the missile in an aft slanted position. The slant angle $\Phi$ will be small and in an order of a few degrees. Further each control panel 16 must be slanted enough that both clockwise and counter clockwise control is provided by the opening and closing of the individual panels 16. The roll control is built in and is not changed during the flight of the missile 12.

Figure 5A:
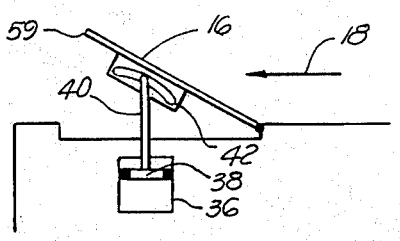
FIG. 5A, 5B, 5C and 5D illustrate different embodiments of an actuator for raising and lowering the control panels.
Figure 5B:
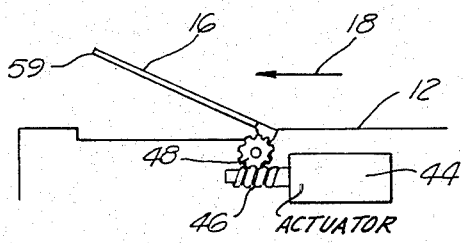
Figure 5C:
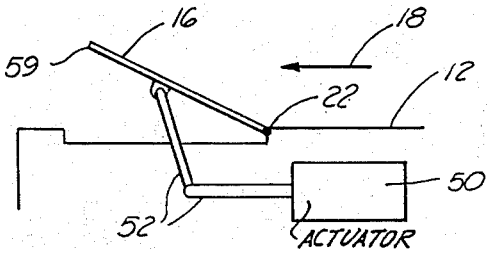
Figure 5D:
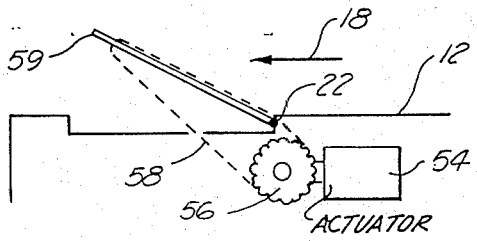

The following discussion describes various types of actuators 20 that can be used equally well in opening and closing the panels 16. In FIG. 5A one example of movement of the control panels is shown. A single piston actuator 36 is shown having a piston 38 with piston rod 40 used for moving the panel 16 with guide 42. FIG. 5B is a worm driven actuator having a actuator 44 with worm gear 46 used for driving a gear section 48 attached to the panel 16. In FIG. 5C a folding hinge actuator is used having an actuator 50 with folding hinge 52 attached to the panel 16. In FIG. 5D, a cable drive actuator is shown having an actuator 54 connected to a sprocket 56 received around an endless control cable 58 mounted on the panel 16. It should be noted that all of the above actuators are designed to open a leading edge 59 of the panels 16 downstream and toward the rear of the missile 12.

Figure 6:
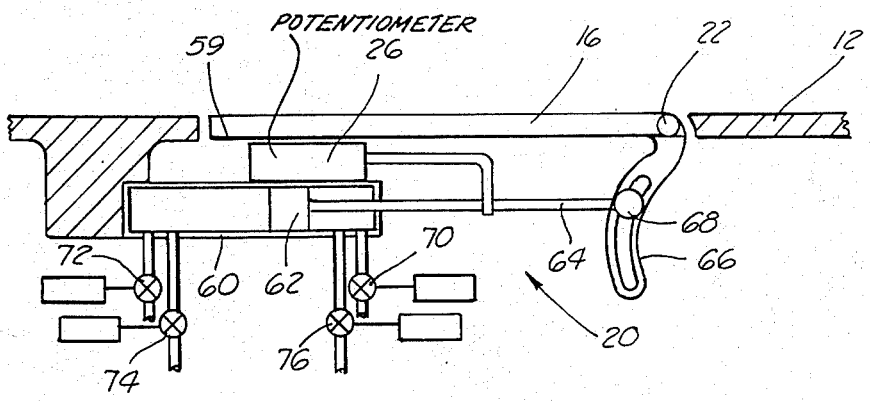
FIG. 6 illustrates a preferred embodiment of the actuator for raising and lowering the control panels.

In FIG. 6 a preferred embodiment of an actuator 20 is illustrated having a two-way actuator drive 60 having a piston 62 mounted therein with an actuator rod 64 extending outwardly therefrom. The end of the actuator rod 64 is attached to a slide lever 66 by an attachment clip 68. The actuator rod 64 is attached to the hinge 22 of the panel 16. The actuator drive 60 is operated by opening either partially or all the way one of two inlet valves 70 or 72 and opening one of two exhaust valves 74 or 76.

In this design, the actuator rod 64 is moved toward the front of the missile when the control panel 16 is to be deployed. The potentiometer 26 is attached to the two-way actuator by an arm 78. The movable arm 78 of the potentiometer 26 is affixed to the actuator rod 64. As the actuator rod 64 is moved, the potentiometer arm 78 is also moved. This provides the knowledge of the position of the actuator rod 64 at all times. The potentiometer 26 provides feedback data to the control system 24.

Changes may be made in the construction and arrangement of the parts or elements of the embodiments as described herein without departing from the spirit or scope of the invention defined in the following claims:

What is claimed is:

1. An on-board missile flight control panel system for controlling the pitch, yaw and clockwise and counter clockwise roll of the missile, the system comprising:

a plurality of control panels hinged on the missile;

an actuator connected to each panel for opening and closing the panels into the airstream of the missile, the actuator opening the panels with the leading edge downstream and toward the rear of the missile, the actuator connected to each panel including a two-way actuator drive with a fluid operated piston mounted therein, an actuator rod extending outwardly from the piston, the end of the actuator rod connected to a slide lever attached to the hinge mounted at one end of the control panel, the two-way actuator drive, when actuated by a operating medium, moving the actuator rod which in turn rotates the slide level thereby raising the leading edge of the control panel downstream and toward the rear of the missile and into the airstream and lowering the control panel into a closed position;

a feedback position measuring device connected to the panels for monitoring the position of the panels; and an autopilot control system connected to each actuator and feedback position measuring device and programmed for determining the required position of the control panels.

2. The system as described in claim 1 further including rate sensors connected to the autopilot control system for indicating actual orientation and rate of change of orientation to the autopilot control system.

3. The system as described in claim 1 wherein the control panels, when in a closed position form part of the missile skin of the missile.

4. The system as described in claim 1 wherein the feedback positioning measuring device is a potentiometer connected to the actuator and on the hinged control panels.

5. An on-board missile flight control drag actuator system for controlling the flight of a missile, the system comprising:

a plurality of control panels hinged on the missile and slanted in an aft position for controlling the clockwise and counter clockwise roll of the missile;

an actuator connected to each panel for opening and closing the leading edge of the panel with the leading edge downstream and towards the rear of the missile, the actuator connected to each panel including a two-way actuator drive with a fluid operated piston mounted therein, an actuator rod extending outwardly from the piston, the end of the actuator rod connected to a slide lever attached to the hinge mounted at one end of the control panel, the two-way actuator drive, when actuated by an operating medium, moving the actuator rod which in turn rotates the slide lever thereby raising the leading edge of the control panel downstream and toward the rear of the missile and into the airstream and lowering the control panel into a closed position;

a potentiometer connected to the actuator and the hinged control panels for monitoring the position of the panels; and an autopilot control system connected to each actuator and potentiometer and programmed for determining the required position of each control panel.

* * * * *